US010306989B2

(12) United States Patent
Tehrani

(10) Patent No.: US 10,306,989 B2
(45) Date of Patent: Jun. 4, 2019

(54) CANTILEVER SEAT

(71) Applicant: Esmail Tehrani, Rockville, MD (US)

(72) Inventor: Esmail Tehrani, Rockville, MD (US)

( * ) Notice: Subject to any disclaimer, the term of this patent is extended or adjusted under 35 U.S.C. 154(b) by 20 days.

(21) Appl. No.: 15/867,284

(22) Filed: Jan. 10, 2018

(65) Prior Publication Data

US 2018/0192775 A1 Jul. 12, 2018

Related U.S. Application Data

(60) Provisional application No. 62/444,871, filed on Jan. 11, 2017.

(51) Int. Cl.

| | |
|---|---|
| ***A47C 7/02*** | (2006.01) |
| ***A47C 1/024*** | (2006.01) |
| *A47C 7/46* | (2006.01) |
| *A47C 7/18* | (2006.01) |

(52) U.S. Cl.

CPC ..... *A47C 7/029* (2018.08); *A47C 1/024* (2013.01); *A47C 7/021* (2013.01); *A47C 7/18* (2013.01); *A47C 7/46* (2013.01)

(58) Field of Classification Search

CPC ..... A47C 7/022; A47C 1/024; A47C 7/029; A47C 7/021

USPC ..... 5/655.3, 654; 297/452.41, DIG. 3

See application file for complete search history.

(56) References Cited

U.S. PATENT DOCUMENTS

| | | | | |
|---|---|---|---|---|
| 5,742,957 | A * | 4/1998 | Vanzant | A61G 5/14 297/DIG. 10 |
| 8,037,560 | B2 * | 10/2011 | Goldner | A47C 7/021 297/DIG. 10 |
| 2008/0313814 | A1 * | 12/2008 | Cheng | A61G 5/14 5/655.3 |
| 2009/0188045 | A1 * | 7/2009 | Anikin | B60N 2/4415 5/654 X |
| 2013/0055504 | A1 * | 3/2013 | Peash | A61G 5/14 5/654 X |

* cited by examiner

*Primary Examiner* — Anthony D Barfield

(74) *Attorney, Agent, or Firm* — Greenblum & Bernstein, P.L.C.

(57) ABSTRACT

The present invention relates to a cantilever seat cushion for reducing lower back strain, including: an inner pre-cut foam; an air tight shell that surrounds the inner pre-cut foam; an outer fabric cover that surrounds the air tight shell; an air valve that adjusts an incline angle of the cantilever seat cushion by deflating or inflating the seat in which the incline angle of the cantilever seat cushion is in a range from 10 to 25 degrees.

16 Claims, 15 Drawing Sheets

Cg

CANTILEVER SEAT

FIELD OF THE INVENTION

The present invention relates generally to a seat cushion. More specifically, the present invention relates to a seat cushion that provides adjustment to the hip socket angle between the torso and the thigh, creating a cantilever effect on the user's femur and thus providing relief to lower back pain.

BACKGROUND OF THE INVENTION

Lower back pain is one of humanity's most frequent complaints and is a common problem. According to The University of Maryland School of Medicine, about 60 to 80% of the adult U.S. population has lower back pain, and it is the second most common reason people go to the doctor. Lower back problems affect the spine's flexibility, stability, and strength, which can cause pain, discomfort, and stiffness.

Statistics from the American Chiropractic Association (ACA) reveal that at least 31 million Americans experience lower back pain at any given time.

Lower back pain is the leading cause of disability in Americans under 45 years old. Each year, 13 million people go to the doctor for chronic back pain. The condition leaves about 2.4 million Americans chronically disabled and another 2.4 million temporarily disabled.

Our industrialized society has transformed into an information processing society in which more employees are transacting business, while proper sitting posture declines after long periods of time. With the advent of the information processing age, it is becoming increasingly clear that there is a significant mismatch between people and the furniture in their home and working environments, as evident from the increasing numbers of employees suffering from chronic back pain. The most likely explanation is improper sitting posture. Most of us are not aware of the best sitting positions, thereby resulting in back pain, lower back pain, neck pain, arm pain and hand pain.

Lower back pain can be caused between muscles, tendons, and discs that are connected to each other by the spine. The main source of lower back pain includes:

- The large nerve roots in the lower back that go to the legs may become irritated;
- The smaller nerves that supply the low back may become irritated;
- The large paired lower back muscles (erector spinae) may become strained;
- The bones, ligaments or joints may become damaged; and
- An intervertebral disc may become degenerating.

Some simple remedies when followed on a daily basis can help us reduce our back pain. Experts from all over the world have formerly been of the opinion that the proper sitting position is the right angle or erect position.

Posture is the position in which we hold our body upright against gravity while standing, sitting or lying down. Good posture involves training our body to stand, walk, sit and lie in positions where the least strain is placed on supporting muscles and ligaments in order to achieve the following:

- keep bones and joints in correct alignment so that muscles are used properly;
- help decrease the abnormal wearing of joint surfaces that could result in arthritis;
- decrease the stress on the ligaments holding the joints of the spine together;

- prevent the spine from becoming fixed in abnormal positions;
- prevent fatigue because muscles are used more efficiently, allowing the body to use less energy;
- prevent strain or overuse problems;
- prevent back and lower backache and muscular pain; and
- contribute to a good appearance.

As shown in FIG. 1 for male and FIG. 2 for female, the sitting bones are literally what humans sit on. The anatomical name is referred to as Ischial Tuberosity. At the center of the diagram in FIGS. 1 and 2 is the sacrum, which consists of 5 fused vertebrae of the human pelvis. What resembles elephant ears on either side of the sacrum is the ilium. At the bottom are two round holes which look like a mask with two eye holes. At the most bottom outer surface of the eye holes of the pelvis are the sitting bones (Ischiums). These bony prominences are felt when sitting on a hard surface with good posture. Tipping the pelvis forward and backward or side-to-side, human subjects become aware of these important bony prominences.

FIG. 3 illustrates how the body is held erect. The thick black lines represent the principal muscles involved in standing. The vertical dotted line indicates the center of gravity, which falls behind the axis of rotation of the hip.

The following Table 1 is a list of male and female body segment percentage weight. Data were derived by de Leva from young athletic Russian subjects in 1996. Data for American and other nationalities in various age categories may very well be different. This data should be sufficient for purpose in this application.

TABLE 1

Body Segment percentage weights

| Segment | Male | Female | Average |
|---|---|---|---|
| Head & Neck | 6.94 | 6.68 | 6.81 |
| Trunk | 43.46 | 42.58 | 43.02 |
| Upper Arms | 5.42 | 5.10 | 5.26 |
| Forearms | 3.24 | 2.76 | 3.00 |
| Hands | 1.22 | 1.12 | 1.17 |
| Thighs | 28.32 | 29.56 | 28.94 |
| Shanks | 8.66 | 9.62 | 9.14 |
| Feet | 2.74 | 2.58 | 2.66 |
| TOTAL | 100% | 100% | 100% |

On a sitting position on a sofa, the weight of a person's head, neck, trunk upper arms, forearms, hands and about ⅓ of thigh's weight are carried on the sitting bones. The ⅓ value for the thigh's weight is an approximation that could be more or less. That is, $6.94+43.46+5.42+3.24+1.22+\frac{1}{3}\times 28.32=69.72$ represent the total body weight of a male that is carried on the sitting bones. For a male weighing 180 lbs., this is calculated to $69.72\%\times 180=126$ lbs. This amount of weight is not aligned with a person's center of gravity, thus, creating a good amount of cantilever force. For as long as a person is sitting, the large paired lower back muscles (erector spinae), many fine muscles, tendons and ligaments in the pelvis area are subjected to severe stress and pressure to keep the body upright against gravity and the cantilever force.

Many complex ligaments connecting Pelvis, Coccyx, Sacrum, Socket Joint of hip and Lumbar Vertebrae (L1-L5) are shown in FIG. 4. Pelvic, Coccyx, Sacrum and Lumbar Vertebrae (L1-L5) are shown in FIG. 5.

These bones are closely connected to each other by large and small muscles, tandems, ligaments, veins, and nerve roots. Prolonged sitting results in extended contraction that restricts veins, nerves and supply of oxygen and nutrition to cells in that area. The irritated and damaged muscles, tandems, ligaments, cartilages, veins and nerves are the main source of lower back pain.

Though sitting down for extended periods of time on sofas, chairs, etc. may be far worse than we realize, a person can minimize its impact by sitting properly. Correct sitting posture means having all the bones in our spine properly supported and lined up correctly.

The following principles of physics and engineering are relevant to achieve proper posture:

1) Body's Center of gravity;
2) Moment of force (weight of hanging legs pulling down femur at knee joint).
3) Femoral head moving in Acetabulum (socket of hip-bone of the pelvis); and
4) Inclined surface of Cantilever seat for lift.

The three skeletons shown in FIGS. 5, 6, and 7 show that the human upper body is supported by the Femur (thigh bone), the Femoral neck and the Femoral head. The center of gravity of the human body is nearly aligned with the head of the femurs, not the sitting bones (ischiums). As a result, when a person sits on a sofa, the pelvic girdle is tilted forward putting much stress on the surrounding muscles, ligaments, tendons, veins, cartridges and nerve cords.

The patent or application file contains at least one drawing executed in color. Copies of this patent or patent application publication with color drawings will be provided by the Office upon request and payment of the necessary fee.

DETAILED DESCRIPTION OF THE INVENTION

The Cantilever Seat is primarily for use by people with back and lower back pain. It is troubling for people with back and lower back pain to sit on sofas, chairs, and plane seats for extended periods of time because these people feel extreme pain when they get up and begin moving around.

This product is inflatable and adjusts its height and firmness according to each individual's weight, limberness, movement and motion. People with back and lower back pain have to get up from the sitting position slowly and carefully. It is very hard to get up from the Cantilever Seat when it is fully inflated.

As mentioned above, about ⅓ of the thigh weight (i.e., ⅓×28.32% of body weight) is on a human pelvis. For a person weighing 180 lbs, this amounts to 18 lbs. This amount of weight is no longer carried on the pelvis when the Cantilever Seat of the present invention is used.

Figure 13:
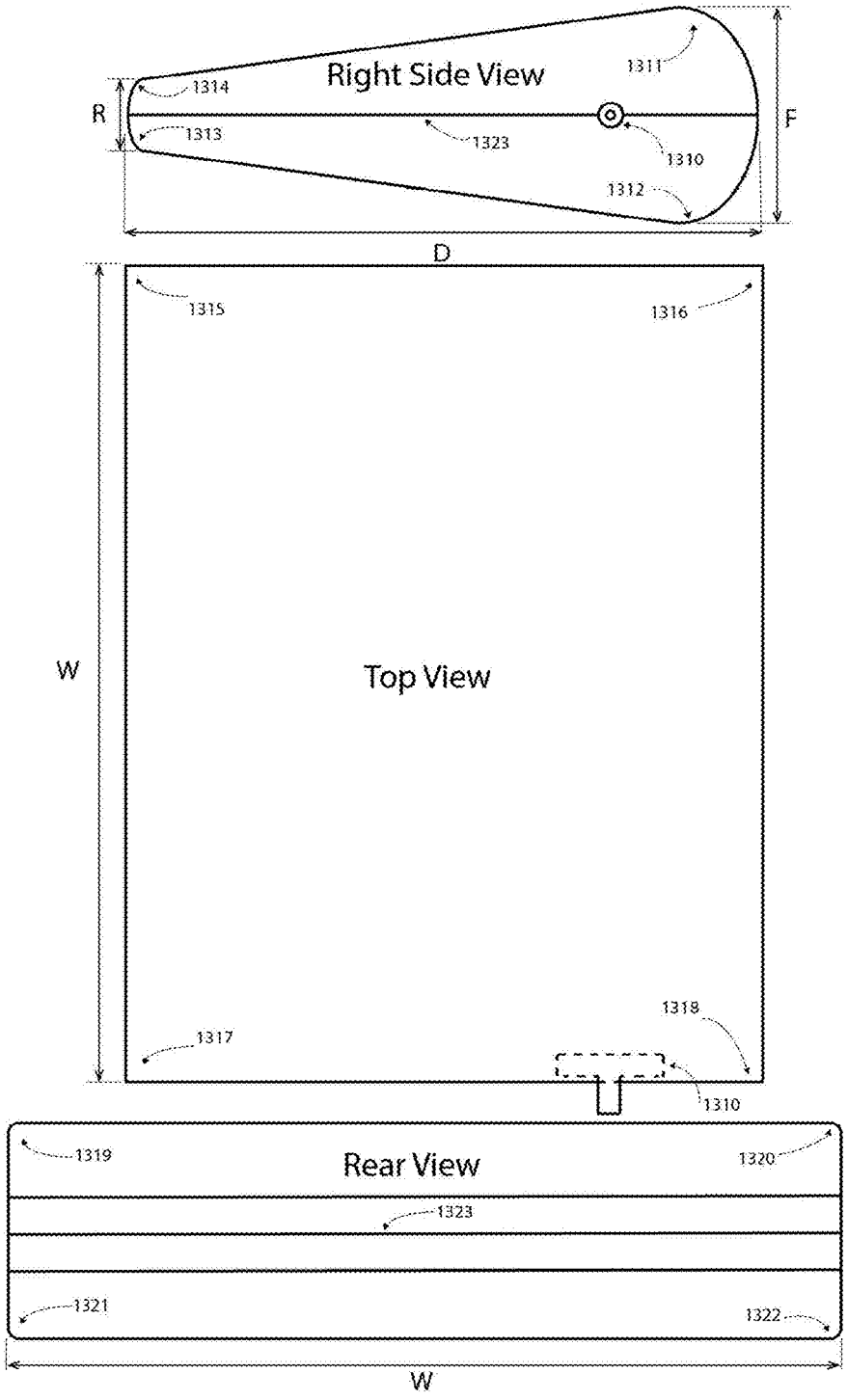
FIG. 13 is drawing of an embodiment of the Cantilever seat.

Nearly all of the 28.32% weight of the two thighs, which are about 36 lbs for a person weighing 180 lbs, rest on the inclined Cantilever Seat. FIG. 13 shows the shape of the Cantilever seat.

Moving a person's body left or right and back or forth, while sitting on the stationary sitting bones is not with physical ease, and puts much stress on the fine muscles, tendons, ligaments, veins and nerves in the pelvis area. On the other hand, moving a person's body left or right and back or forth, while sitting on the Cantilever Seat is much easier because the large Femoral head can easily move inside the socket joint of the hip.

The hip joint is located between the femur and the pelvis. The primary function of the hip joint is supporting the body weight in both static (e.g. standing) and dynamic (e.g. walking or running) postures. The hip joints are important in retaining the physical structural balance of a person.

Figure 14:
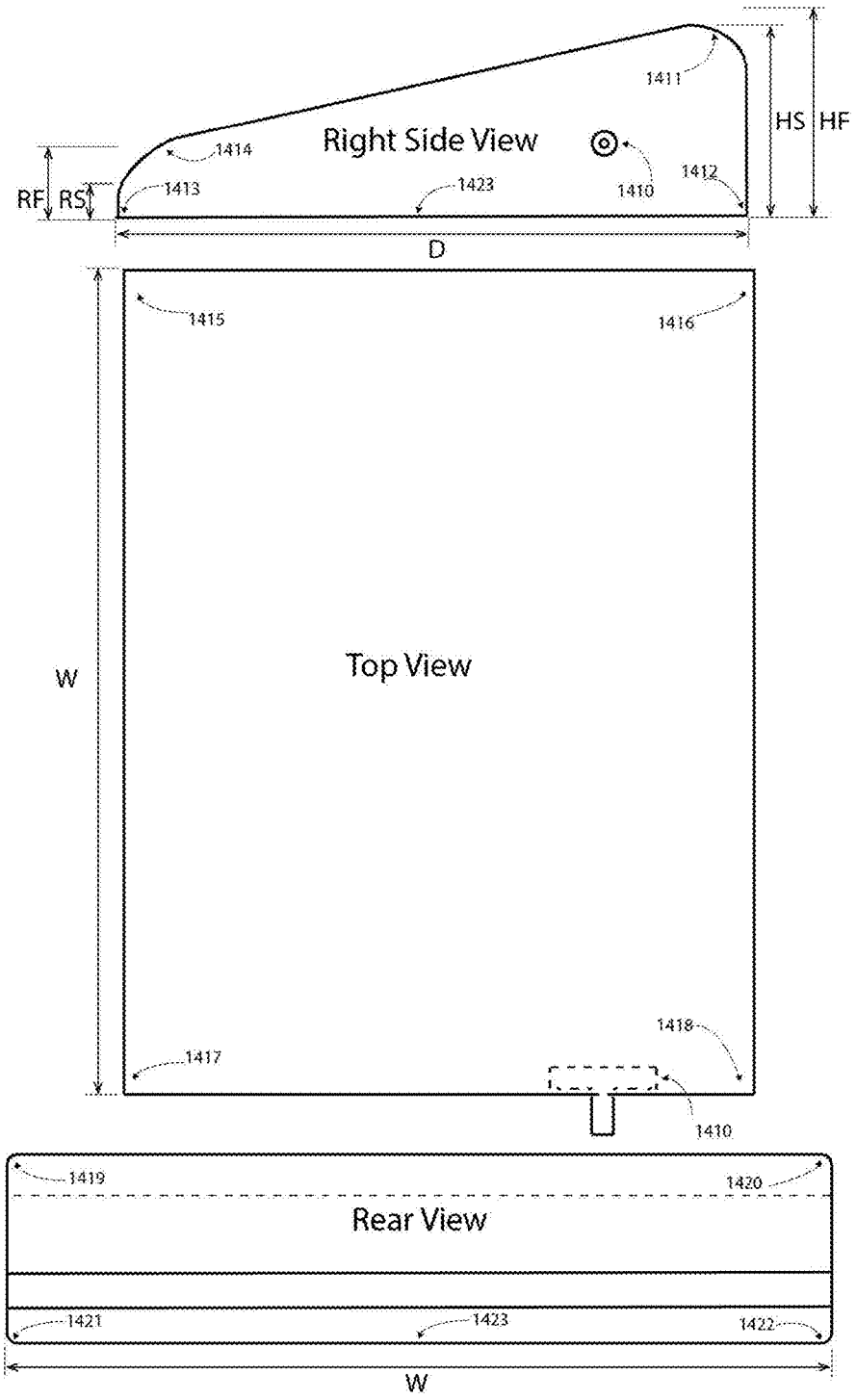
FIG. 14 is drawing of yet another embodiment of the Cantilever seat.

In one embodiment, the Cantilever seat is equipped with an air valve, as shown in FIG. 13 as 1310 and FIG. 14 as 1410. The Cantilever seat is made of any rigid plastic material that is readily available on the market. The seat deflates by twisting the valve counter clock-wise to open, and pressing or sitting on it. The seat re-inflates by leaving the air valve open. For extra stiffness, a person can add air and close the valve clockwise. The valve can be located on the left-side, front-side or the right-side of the Cantilever seat. In another embodiment, the air release valve may be attached to a plastic tube for accessibility by handicapped persons.

In another embodiment, the air valve can be a DC battery or AC powered mini air valve with a switch to inflate or deflate the Cantilever seat. The mini air valve may have a remote control to deflate or inflate the seat.

In yet another embodiment, the seat may also have a quick air release valve in addition to the above mentioned valves. The quick air release valve is air tight with a cap. The air in the seat can be released quickly by pulling the cap away from the seat. It is made of any semi-rigid plastic that is readily available in the market. It may be located on the left-side, front-side or the right-side of the Cantilever seat.

Figure 1:
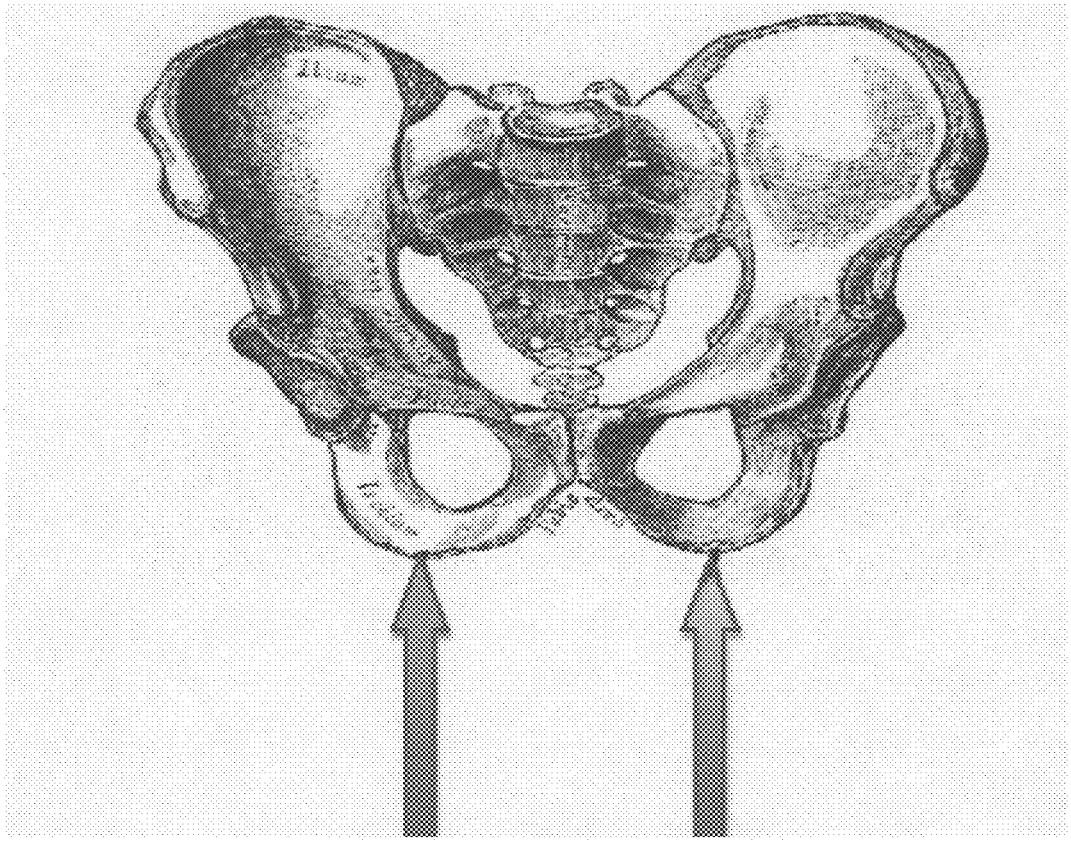
FIG. 1 is a front view of a male pelvis.
Figure 2:
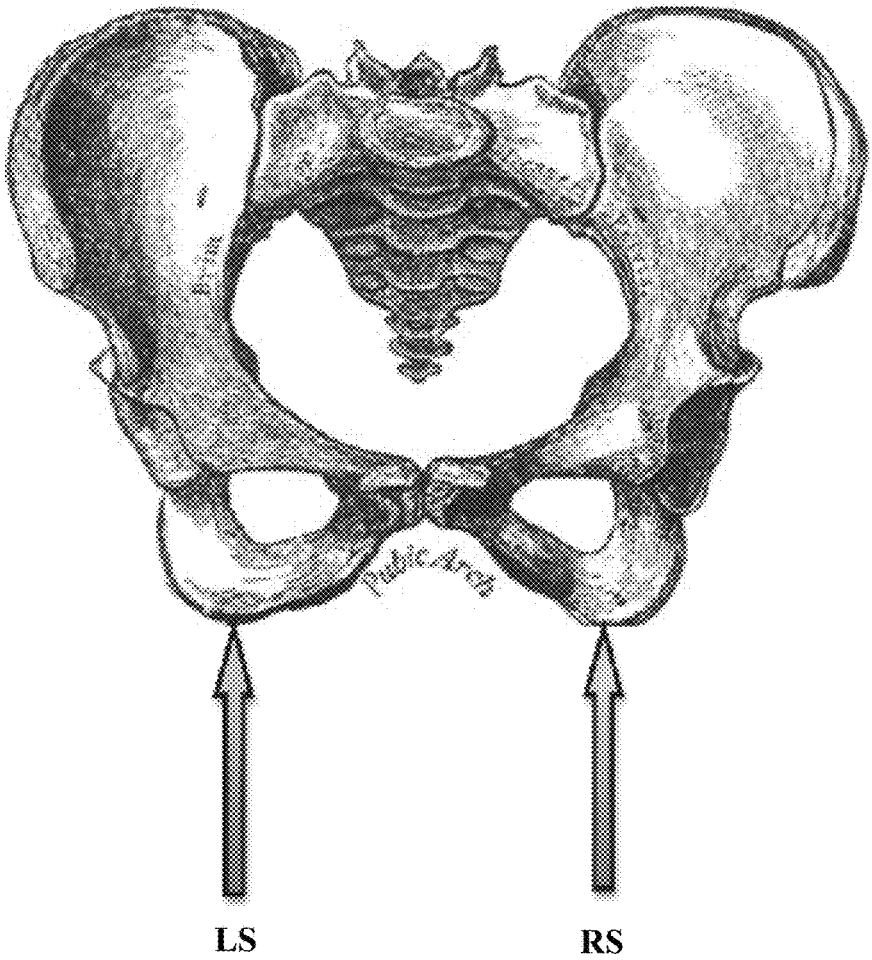
FIG. 2 is a front view of a female pelvis.
Figure 3:
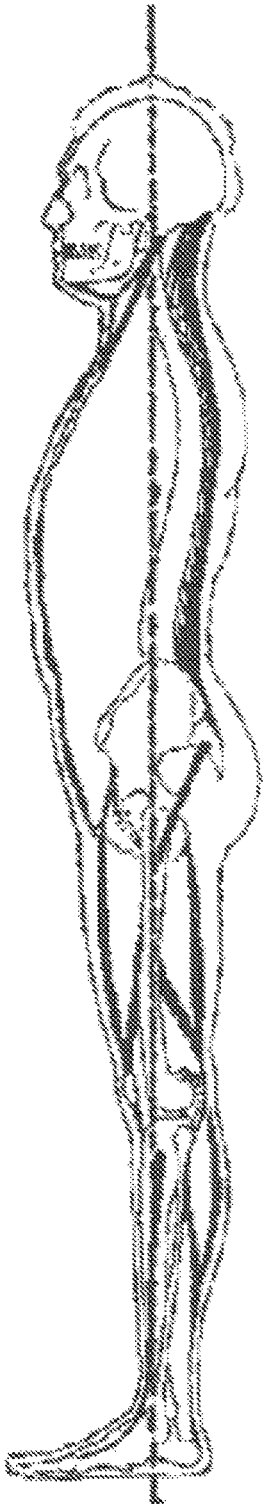
FIG. 3 is a left view of a human body, with a line representing the center of gravity.
Figure 4:
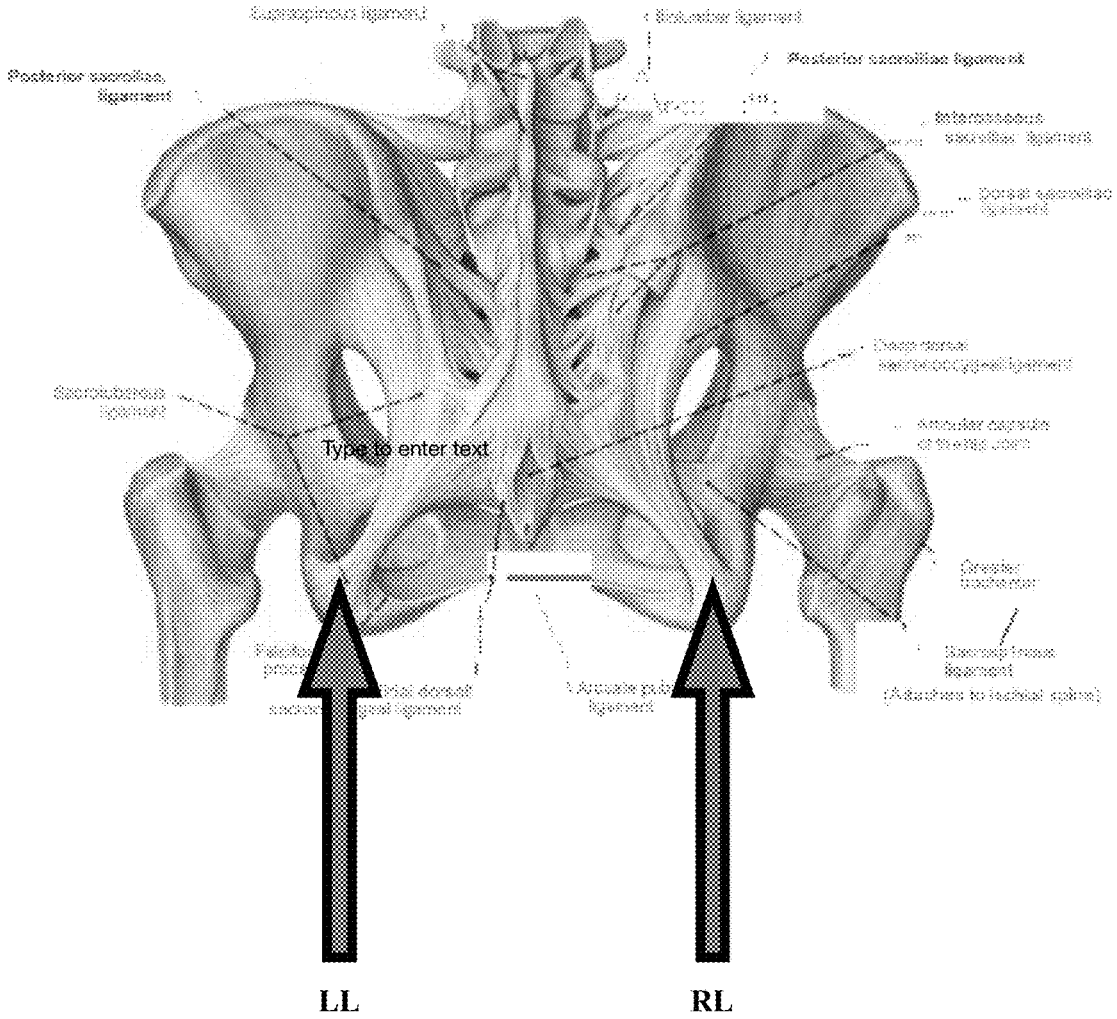
FIG. 4 is a rear view of the pelvis and ligaments.
Figure 5:
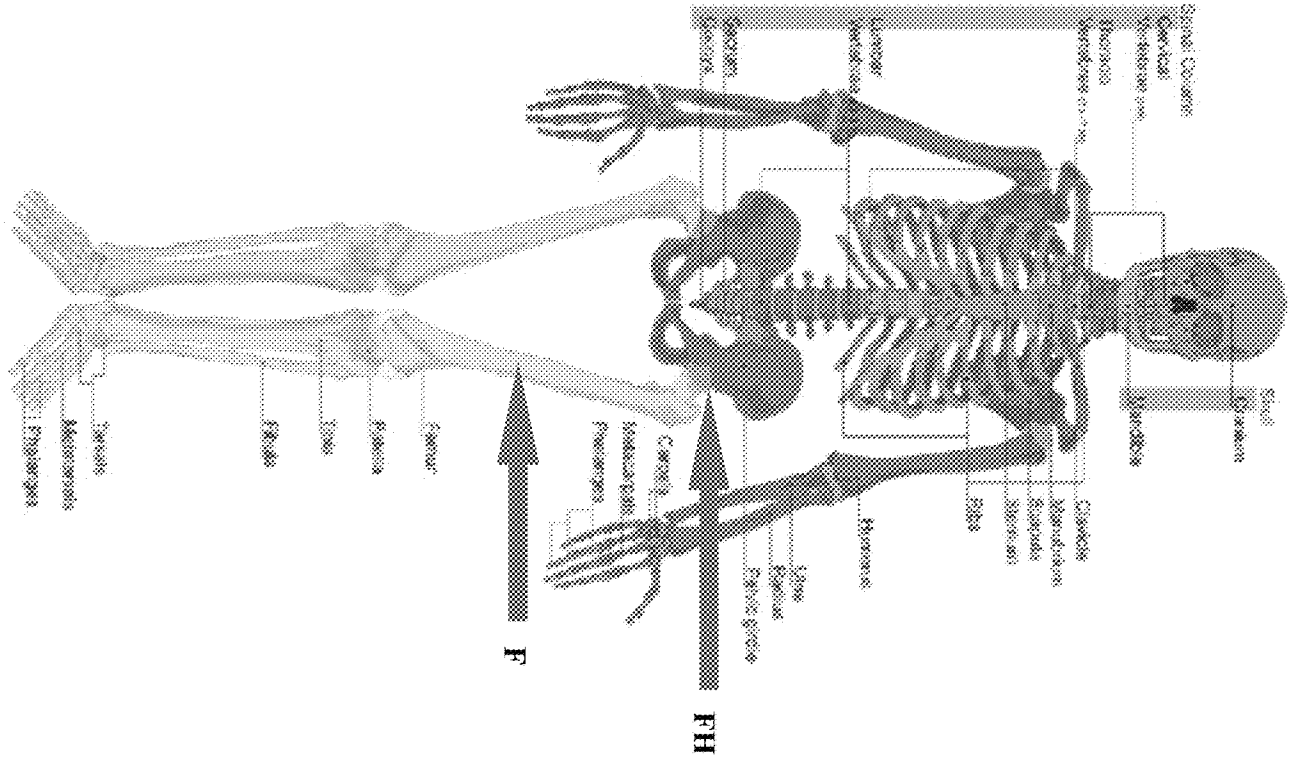
FIG. 5 is a front view of a human skeleton.
Figure 6:
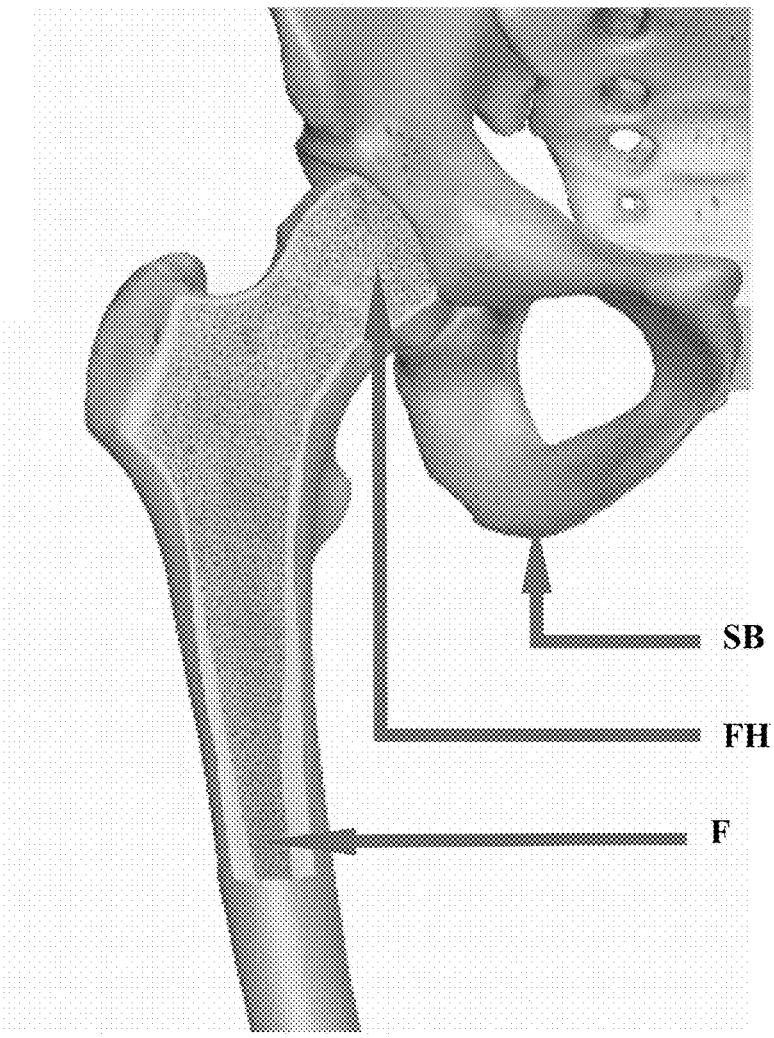
FIG. 6 is a front view of the Femoral head and hip socket joint.
Figure 7:
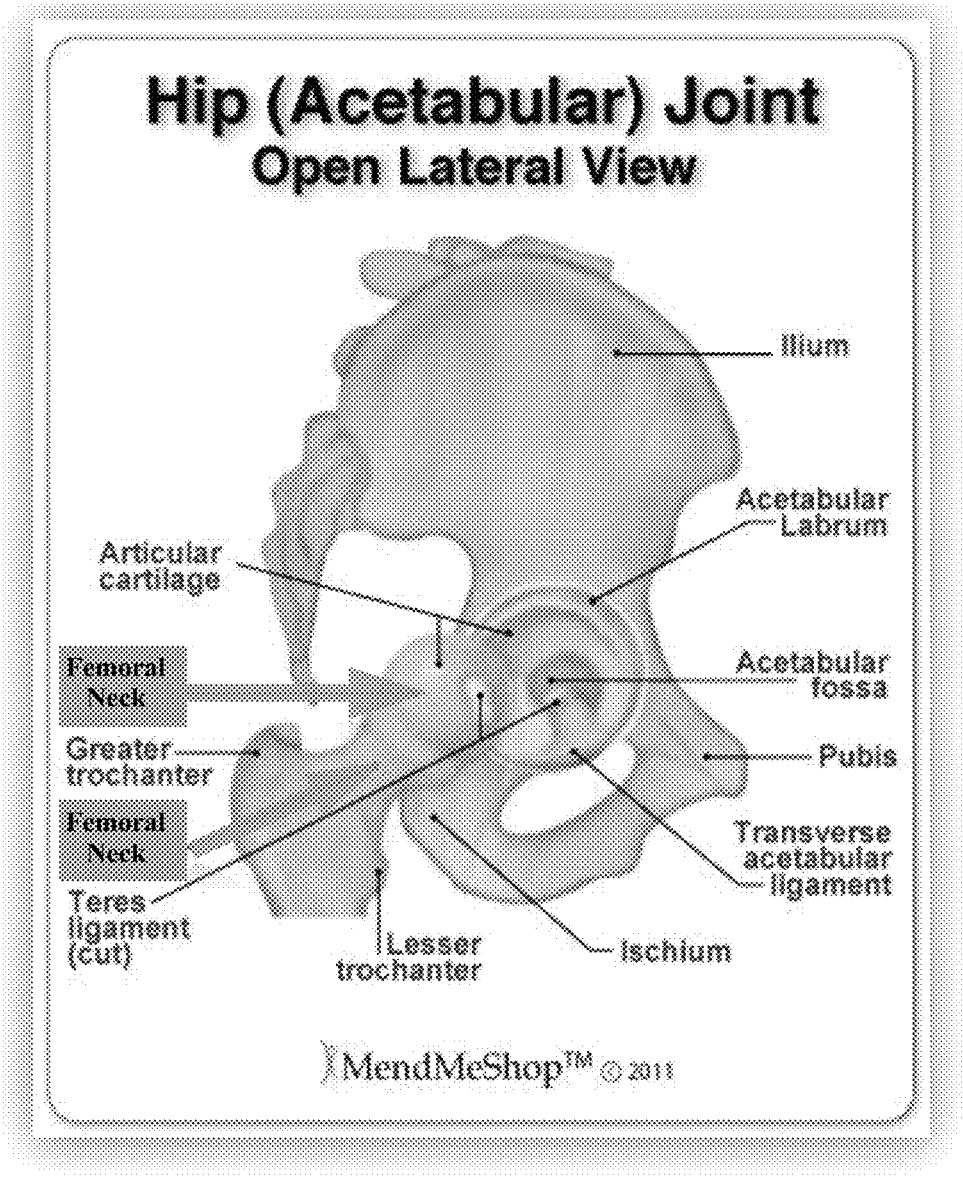
FIG. 7 is a front view showing the connection of the Femoral head and the Femoral neck of the femur to the pelvis.
Figure 8:
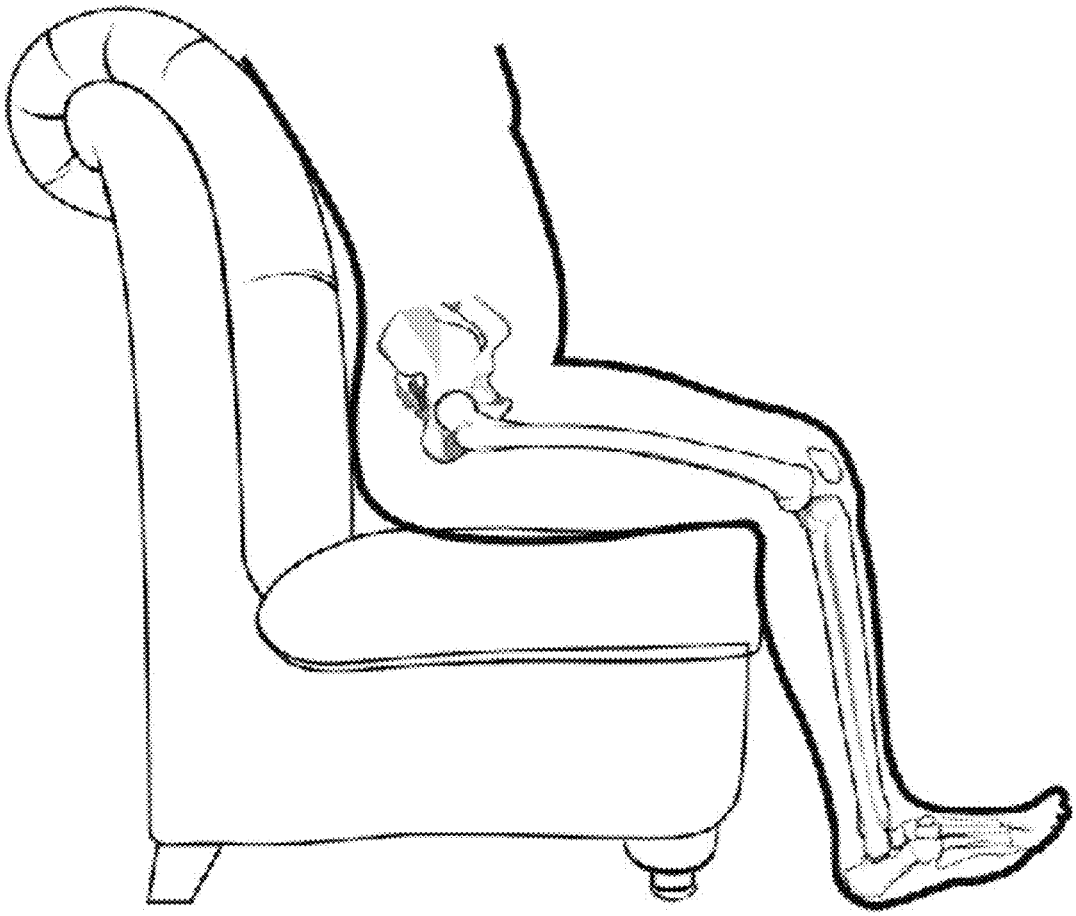
FIG. 8 is a diagram showing the contour of a male person sitting on a sofa.
Figure 9:
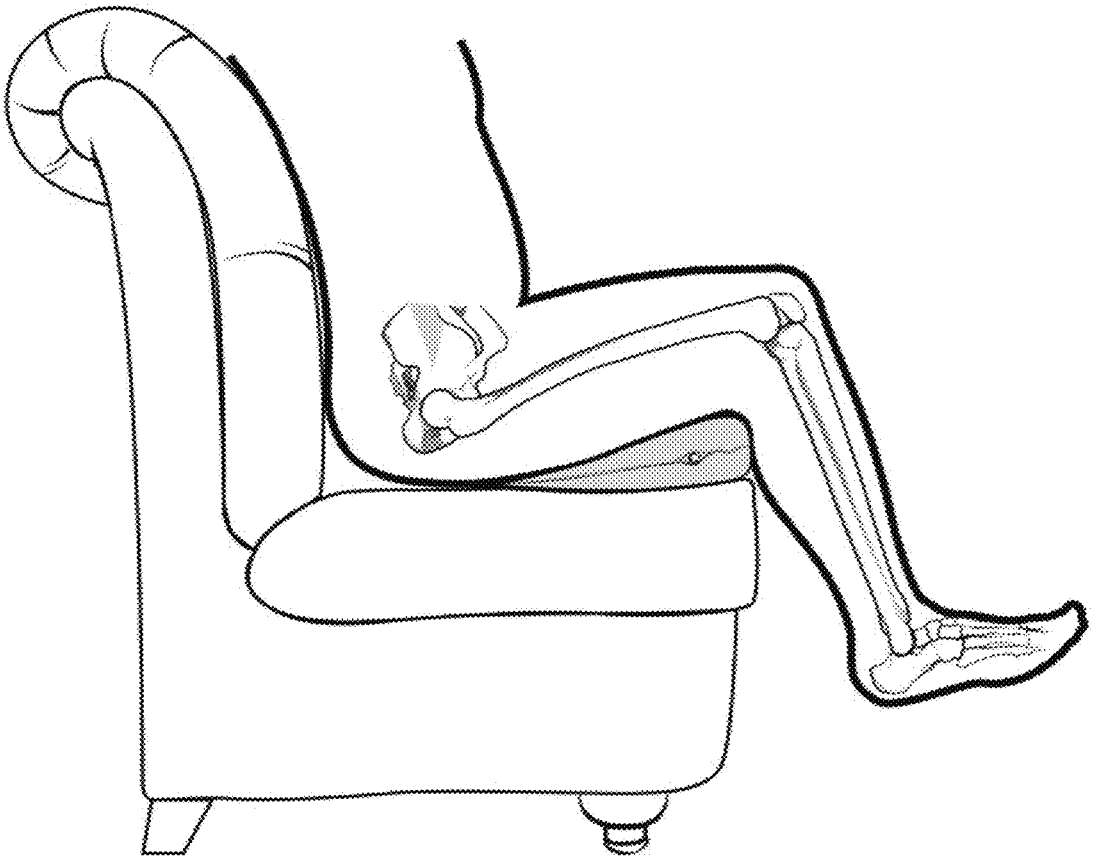
FIG. 9 is a diagram showing the contour of a male person sitting on the inclined surface of the Cantilever seat.

FIG. 8 shows the femur position and the contour of a male person sitting on a sofa. The lumbar and lower back are not supported by a sofa's back cushion. The upper body (head, neck, arms and trunk), which is about 60% of total body's weight, is carried on the two sitting bones (Ischium bones). Also, about ⅓ of the thighs' weight is carried over the same two sitting bones. That is an additional 10% of the body's total weight. Please see Table. 1. Most of this 60% that includes abdominal weight is off center from the sitting bones. This tends to create a cantilever force on the lower spine. The lower spine is not a rigid structure, and the body's lumbar tends to curve away from sitting bones and the sofa's back cushion because of the abdominal weight and the body's center of gravity FIG. 9 shows the femur position and the contour of a male femur position on a sofa with an inclined Cantilever Seat. FIG. 9 illustrates the lower back and lumbar resting on the sofa back cushion. The force due to gravity (weight) of the legs and feet on the inclined seat includes:

a) The Normal force that is a perpendicular force exerted on the femur at the knee joint. The Normal force pushes up at the other end of femur at the hip joint socket.

b) The corresponding force component acts along the incline direction on the femur. The corresponding force pushes the femur at the hip joint against the seat back cushion.

Similarly the weight of the thighs on the incline surface of the Cantilever seat creates a Normal force and a corresponding force. Again, the Normal force pushes up the other end of the femur at the hip joint socket, and the corresponding force pushes the femur at the hip joint against the seat back cushion.

The two vertical forces at the hip joint socket, which are close to the body's center of gravity, lift the trunk off the seat, thereby reducing pressure on the two sitting bones. The two forces created along the incline surface of the Cantilever seat push the pelvis against the seat back cushion.

Nearly all sofas, chairs and seats in homes and office furniture, vehicles, trains and airplanes are slanted backwards. Also, the spine is composed of 33 interlocking bones (vertebrae) that are separated by soft, compressible discs supported by many ligaments and muscles.

The combination of four forces, mentioned above, lift the body and push the lower back and lumbar over the sofa back cushion. As a result, the upper body and the sitting bones are lifted up, and the pelvis and the lumbar are straightened. The straightened lower back and lumbar help the spine become upright and erect. The shoulders move back, the chest opens-up, breathing become easier, and the upper body posture improves.

Figure 10:
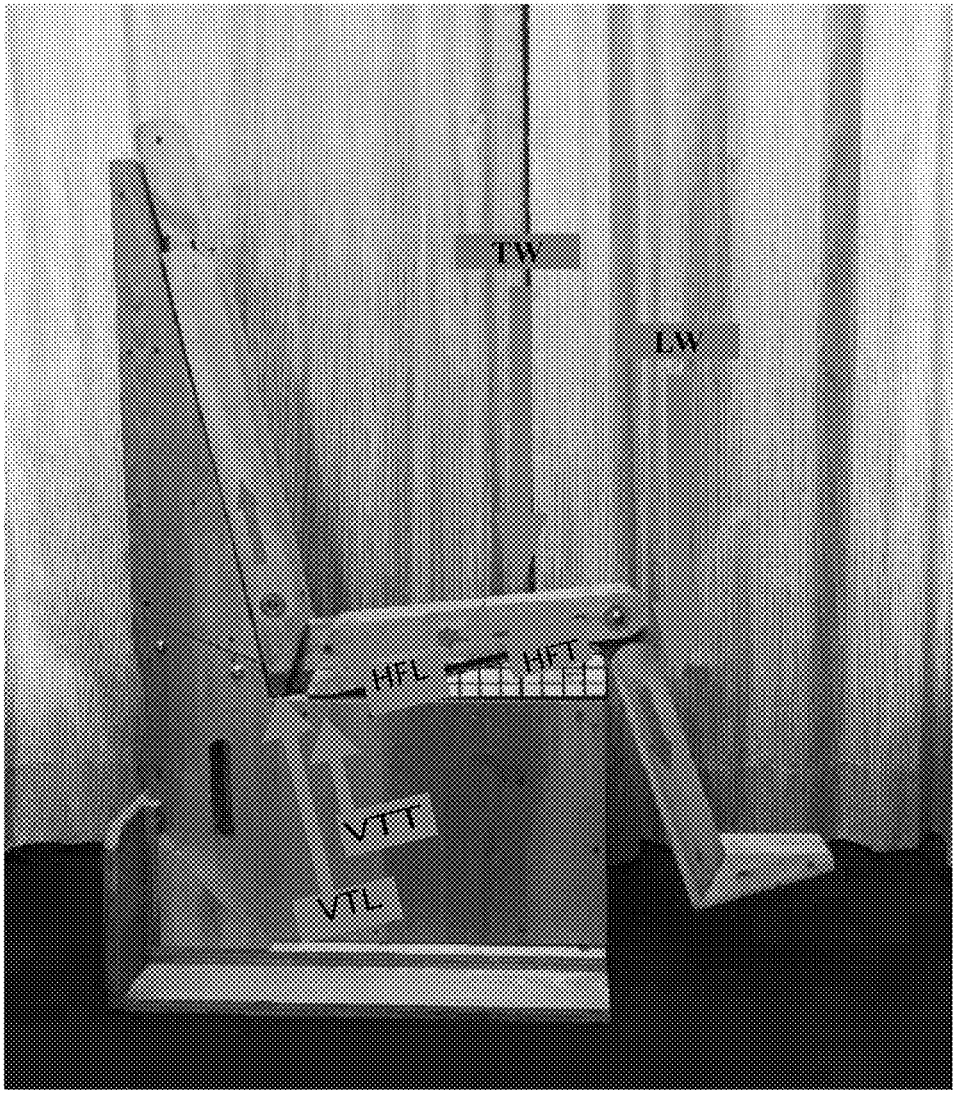
FIG. 10 is a maquette showing normal forces, corresponding forces and the Moments on an inclined surface.
Figure 11A:
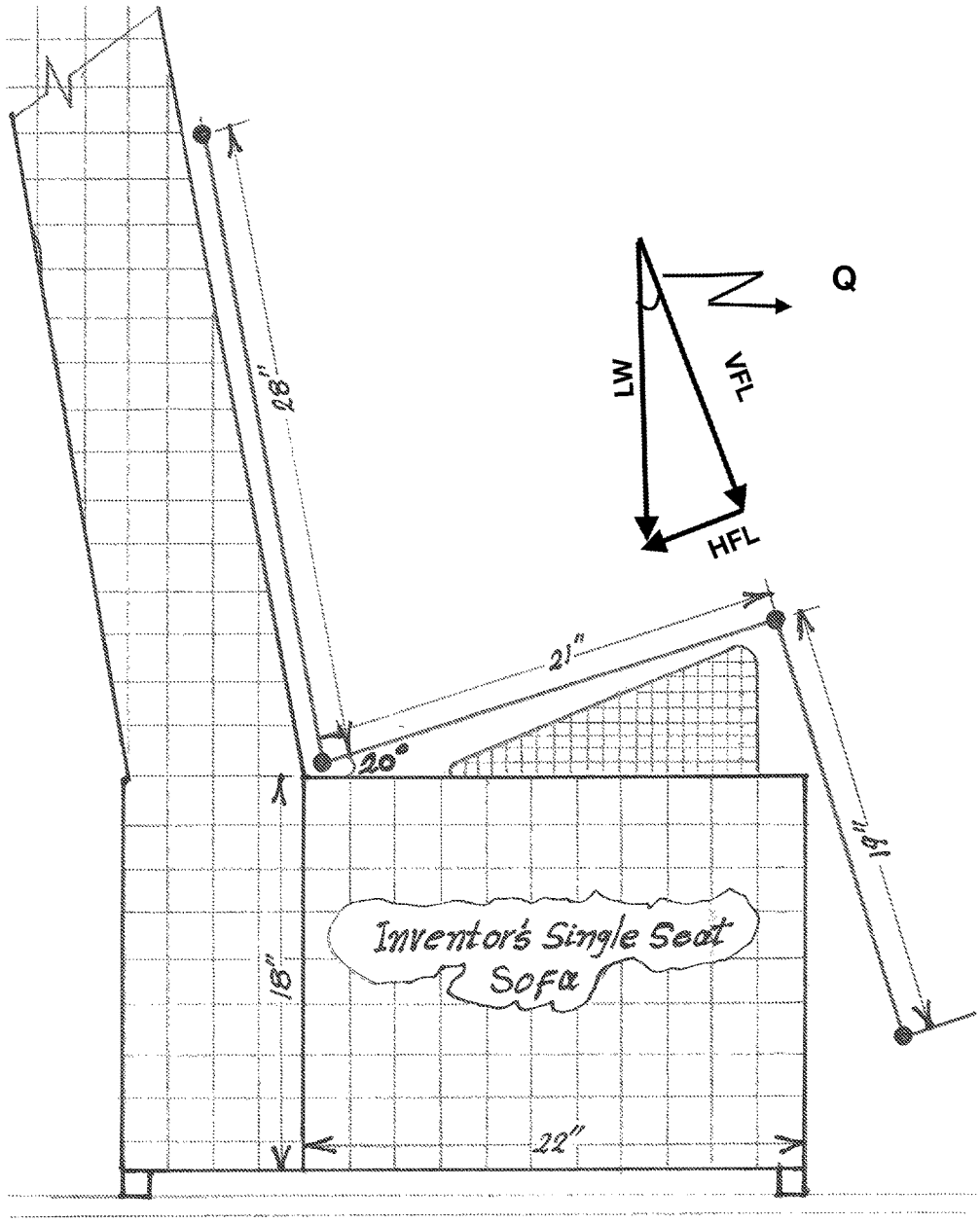
FIG. 11A is a left view force diagram representing the cantilever effects in an embodiment of the present invention at the knee.

FIGS. 10 and 11A show the forces by gravity (weight) of the feet and legs pulling down the femur where:

LW: Leg weight (force due to gravity),

VFL: force perpendicular to the femur at the knee joint (LW×Cos Φ),

HFL: Corresponding force acting on femur along incline surface of seat (LW×Sin Φ), DkL: Distance from axis of knee to reference point on the Femoral head at the Hip joint, DfL: Distance from axis of the femoral head to reference point on the femur, Φ: Inclined angle of Cantilever seat, VTL: Moment of force acting on the Femoral head at the Hip joint socket, HFL: Corresponding force pushing femur at hip joint against seat back cushion.

Moment of force: is defined with respect to a fixed (reference point), and relates to physical quantities as measured at some (distance) from that reference point. For example, the Moment of force acting on an (object), often called torque, is the product of the force and the distance from a reference point.

The Moment of force acting on the Femoral head at the Hip joint socket that pushes up the two sitting bones is: VTL=2×VFL×DkL:Df.

The corresponding force that pushes the femur at the hip joint against the seat back cushion is =2×HFL.

Figure 11B:
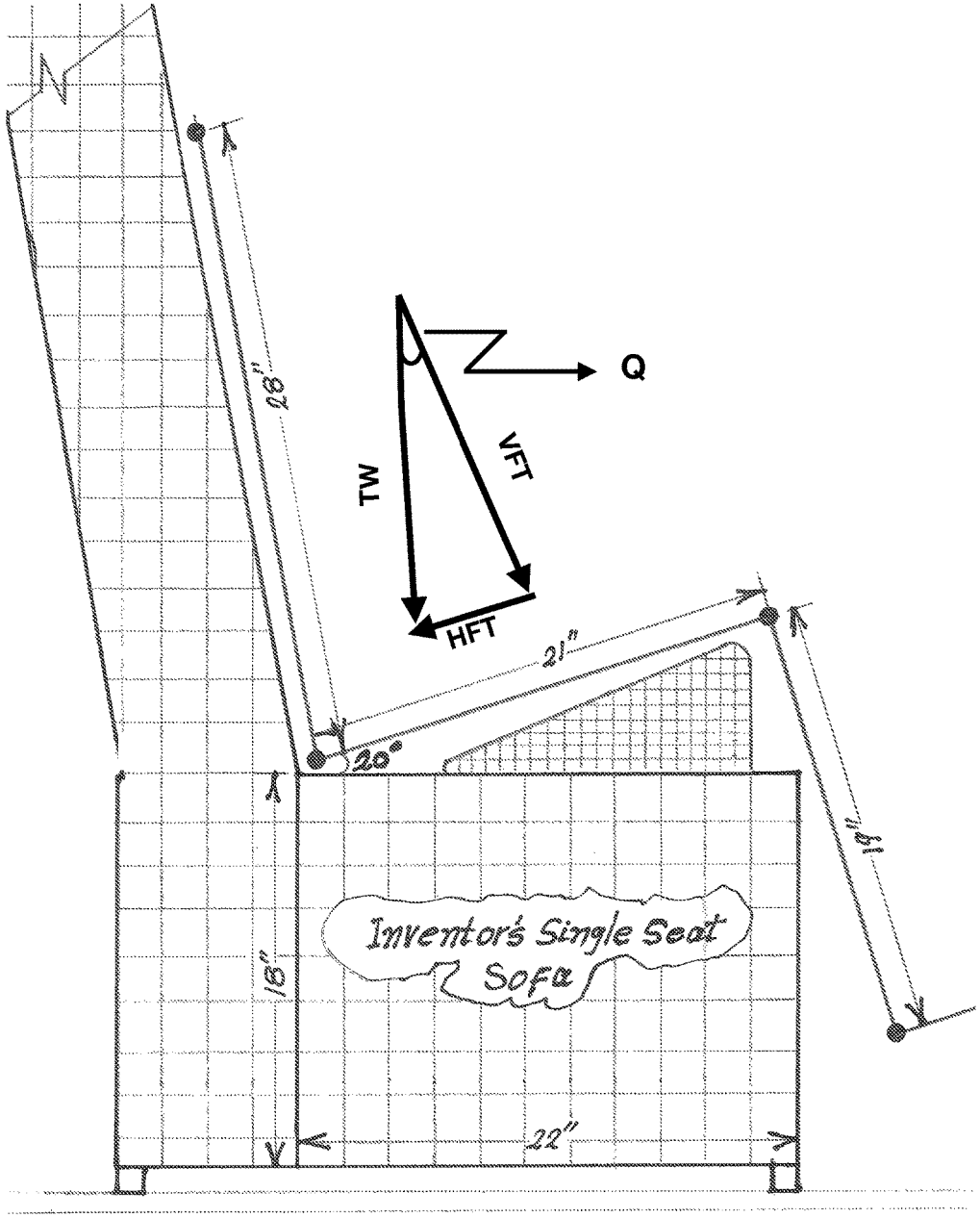
FIG. 11B is a left view force diagram representing the cantilever effects in an embodiment of the present invention at the thigh and the femur.

FIGS. 10 and 11B show the forces that are created by gravity (weight) of the thighs. The weight of the thighs sliding over the inclined Cantilever Seat towards the sofa back cushion creates vertical and horizontal forces on the femur. The downward vertical force pulls up the end of the Femoral head at the hip joint socket. The horizontal force pushes the pelvis against the sofa back cushion:

TW: Thigh weight (force due to gravity),

VFT: Force perpendicular to femur (TW×Cos Φ),

HFT: Corresponding force acting on femur along incline surface of seat (TW×Sin Φ), CHM: Center of hip mass as the mean position of the entire hip mass distribution, DrC: Distance from CHM to reference point on femur, DrF: Distance from axis of Femoral head to reference point on the femur, Φ: Incline angle of Cantilever seat, VTT: Moment acting on Femoral head at Hip joint socket, VCT: Corresponding force pushing femur at hip joint against seat back cushion, [Femoral head] . . . [Reference point] . . . [CHM] . . . [Knee joint]

The Moment of force acting on the Femoral head at the Hip joint socket that pushes up the two sitting bones is: VTT=2×VFT×DrC:DrF.

The corresponding force that pushes the femur at the hip joint against seat back cushion is: VCT=2×HFT.

The above four forces acting on the femur and the Femoral head lift up the sitting bones off the seat and push the pelvis and the lumbar against the seat back cushion. The magnitude of these four forces may be estimated, but expensive scientific instruments are necessary to make accurate calculations.

Figure 12:
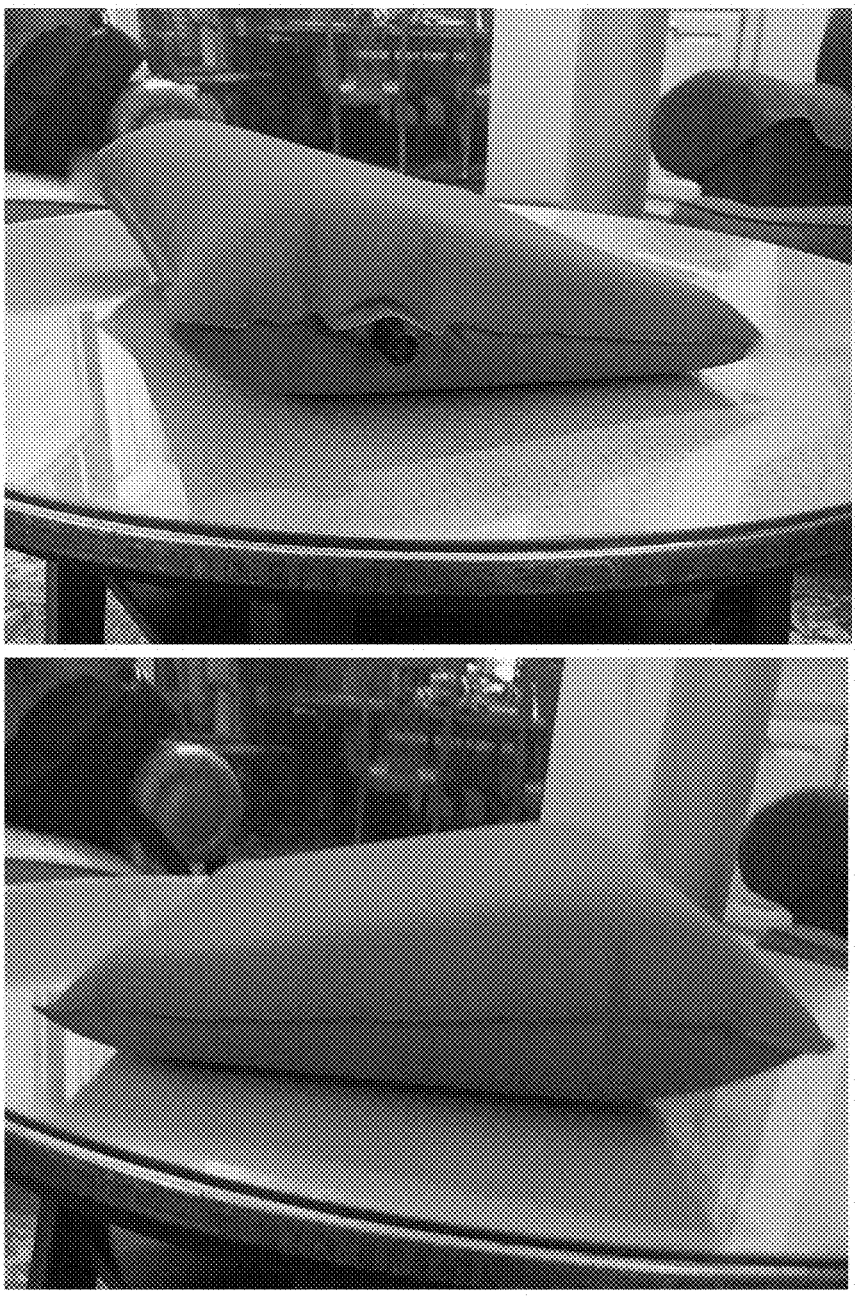
FIG. 12 is the left and right views of the Cantilever seat.

FIG. 12 shows photos of the left and right sides of the Cantilever seat, which includes the following parts:

(a) The inner part is a pre-cut foam. It can be made of any type of synthetic foam. The open cell thermosetting polyurethane (PU) is the preferred material. The foam cut is shown in FIGS. 13 and 14, except it has all 8 edges and 8 corners straight before assembly.

(b) The foam (a) above is sandwiched with an air tight shell that covers top, bottom and all the sides. The air tight shell can be composed of any air tight material. Preferably, the air tight shell material is PVC, Thermoplastic polyurethane (TPU) and combinations thereof. TPU is any of a class of polyurethane plastics with many properties, including elasticity, transparency, and resistance to oil, grease and abrasion. The air tight shell layer on top and the bottom are large enough to cover all four sides and extend beyond the foam boundaries of about 1".

(c) The air tight shell (b) above is covered with any type of natural, synthetic, hand made woven or knitting fabric. The fabric on the top and the bottom are large enough to cover all four sides and extend beyond the foam boundaries of about 1".

(d) The air tight shell (b) and the outer fabric (c) may be replaced by any type of fabric having air tight backing material or may be laminated with an air tight material. The fabric on the top and the bottom are large enough to cover all four sides and extend beyond the foam boundaries of about 1".

(e) The product is equipped with an air release valve and may also have a quick air release valve as discussed above.

The air release valve is placed between the top and bottom layers of the air tight shell b) on the left, the right or the front side of the Cantilever seat. Then, it is placed in a mold pressed and heated. The synthetic foam, the air tight shell and the cover fabric are heat welded together. This process produces a welded seam that projects out where the upper and lower air tight shell and the fabric cover meet. The welded seam (e.g., 1") around the sides of the Cantilever seat is carefully trimmed to about ½".

The same procedure applies for making the Cantilever seat when an air-tight synthetic laminated fabric or, a fabric with air-tight syntactic backing is used in place of the air tight shell (b) and the cover fabric (c).

The Cantilever seat can be inflated and deflated. It can be deflated by opening the valve, pressing hard on the seat, closing the valve to prevent air returning back in the seat, and rolling the seat for storage or carrying. The valve remains closed when it is rolled up. The Cantilever seat has a cylindrical shaped carry bag made from any type of fabric.

To use the seat, the air release valve is opened, foam expands and sucks air into the seat. Once the foam has fully expanded, the valve is closed and the Cantilever seat is ready for use.

There are many conventional seats, back support, lumbar support, neck support and pillows made from memory foam and other materials that exist in the market. However, the height and stiffness of the conventional seats are not adjustable to the weight of a person. Moreover, conventional seats have a different orientation from the Cantilever seat, i.e., they slope towards the front. On the contrary, the Cantilever seat slopes towards the rear of the seat.

Unlike memory foams, the seat cushion of the present invention can be finely tuned and adjusted for height and stiffness to a person's weight, size and comfort. The support and Normal pressure on the thigh's contour are very evenly distributed. Most of the upper body weight is carried on the Femoral heads, the femurs and the thighs, not on our sitting bones.

Memory foams, often used by handicapped people for time periods of hours or longer, need to be washed due to body perspiration penetrating in the foam. However, body perspiration cannot penetrate into the Cantilever seat.

Because of the shape, ability to adjust height, adjust stiffness and adjust resilience, tests have shown that the Cantilever seat of the present invention has a wide range of applications.

The present invention can be used for lower back pain, lumbar support, neck support, posture improvement, as a pillow, and can be placed under the thighs when lying down to relieve back pain.

The present invention can be made in different colors and sizes suitable for use by people of all ages, weights and heights.

The Cantilever seat can be used on any chair, sofa, vehicle, train, airplane, etc.

The Cantilever Seat can be used as a standalone, on top of, or incorporated into seats (e.g., sofas, chairs, recliners, seats of any vehicles, such as airplanes, trucks, buses, minibuses, vans, cars, and wheelchairs).

FIGS. 13 and 14 are drawings of the Cantilever seat. F is front side height, R is rear side height, D is the depth size and W is the width size of the Cantilever seat. The edges and corners 1311 to 1322, and 1411 to 1422 can be straight or rounded depending on how much the air tight shell and the fabric are stretched over the foam. Parts 1310 and 1410 are the air release valves. Parts 1323 and 1423 are seam lines where the air tight shell and fabric are heat welded. The foam, shell and the fabric must be heat welded together on all surfaces of the Cantilever seat to be functional and effective.

The incline angle's broad range is 10 to 25 degrees, more preferably 15 to 22 degrees, and most preferably 20 degrees. The user can adjust the incline angle by releasing air when sitting on the Cantilever seat.

TABLE 2

Seat size ranges when used as stand alone

| | Broad Range | More preferably | Most Preferably |
|---|---|---|---|
| F | 3 to 8 inches | 4 to 6 inches | 4.5 inches |
| R | 1 to 4 inches | 2 to 4 inches | 1.5 inches |
| D | 8 to 20 inches | 12 to 16 inches | 13 inches |
| W | 10 to 26 inches | 16 to 22 inches | 18 inches |

Although the invention has been explained in relation to its preferred embodiments, it is to be understood that many other possible modifications and variations can be made without departing from the spirit and scope of the invention as hereinafter claimed. The concept of this invention can be incorporated into and be part of the body of a seat (e.g., chair, sofa, seat of any vehicle, such as trains, cars and airplanes).

REFERENCES

1. DEYO, M D, Richard A. *Watch Your Back*. Cornell University Press, 2014.
2. Mckenzie, Robin. *Treat Your Own Back*. Orthopedic Physical Therapy Products, 2010.

The invention claimed is:

1. A cantilever seat cushion for reducing lower back strain, comprising:

(a) an inner pre-cut foam;

(b) an air tight shell that surrounds the inner pre-cut foam;

(c) an outer fabric cover that surrounds the air tight shell;

(d) an air valve that adjusts an incline angle of the cantilever seat cushion by deflating or inflating the seat, wherein the incline angle of the cantilever seat cushion is in a range from 10 to 25 degrees, wherein said cantilever seat cushion has six surfaces and has a front side height (F) of 3 to 8 inches, a rear side height (R) of 1 to 4 inches, a depth (D) of 8 to 20 inches and a width size (W) of 10 to 26 inches, wherein the cantilever seat cushion is washable, and wherein the cantilever seat cushion creates four forces that act on a femur in each leg causing a femoral head in each leg to lift up the sitting bones off the seat and push the pelvis and the lumbar against a seat back cushion, said four forces are:

(1) a moment of force caused by weight of hanging legs and feet that acts on the femoral head at a hip joint socket that pushes up the two sitting bones according to formula 1:

$$VTL=2\times VFL\times DkL:DfL,$$

VTL is moment of force acting on the femoral head at the hip joint socket,

VFL is force perpendicular to the femur at the knee joint which is [leg weight]×[Cos Φ], Φ is inclined angle of the cantilever seat, DkL is distance from axis of knee to reference point on the femoral head at the hip joint, and DfL is distance from axis of the femoral head to reference point on the femur, (2) a corresponding force that pushes the femur at the hip joint socket against the seat back cushion according to formula 2:

$$2\times HFL,$$

HFL is corresponding force acting on the femur along incline surface of seat which is [Leg weight]×[Sin Φ], (3) a downward vertical force caused by weight of thighs on an incline surface that acts on a femoral head at a hip socket that pushes up two sitting bones according to formula 3:

$$VTT=2\times VFT\times DrC:DrF,$$

VTT is moment acting on femoral head at the hip joint socket,

VFT is force perpendicular to the femur which is [thigh weight]×[Cos Φ],

DrC is distance from CHM to reference point on the femur,

CHM is center of hip mass as the mean position of entire hip mass distribution,

Drf is distance from axis of femoral head to reference point on the femur, and (4) a corresponding force to the downward vertical force that pushes the femur at the hip joint against the seat back cushion according to formula 4:

$$VCT=2\times HFT,$$

VCT is corresponding force pushing the femur at hip joint against seat back cushion, HFT is corresponding force acting on the femur along incline surface of seat which is [thigh weight]×[Sin Φ].

2. The cantilever seat cushion according to claim 1, wherein the inner pre-cut foam, the air tight shell, and the outer fabric cover are heat welded together.

3. The cantilever seat cushion according to claim 1, wherein the inner pre-cut foam is synthetic foam.

4. The cantilever seat cushion according to claim 1, wherein the inner pre-cut foam is an open cell polyurethane (PU).

5. The cantilever seat cushion according to claim 1, wherein the air tight shell is composed of plastic.

6. The cantilever seat cushion according to claim 5, wherein the plastic is at least one selected from the group consisting of polyvinyl chloride (PVC), thermoplastic polyurethane (TPU) and combinations thereof.

7. The cantilever seat cushion according to claim 1, wherein the outer fabric cover is natural, synthetic, woven, knitted or a combination thereof.

8. The cantilever seat cushion according to claim 1, wherein the cantilever seat cushion has an incline angle of 15 to 22 degrees.

9. The cantilever seat cushion according to claim 1, wherein the cantilever seat cushion has an incline angle of 20 degrees.

10. The cantilever seat cushion according to claim 1, wherein the air valve is a quick air release valve.

11. The cantilever seat cushion according to claim 1, wherein the air valve is attached to a plastic tube.

12. The cantilever seat cushion according to claim 1, wherein the air valve is DC or AC powered.

13. The cantilever seat cushion according to claim 12, further comprising a remote control to operate the DC or AC powered air valve for inflation or deflation.

14. A cantilever seat cushion for reducing lower back strain, comprising:

(a) an inner pre-cut foam;

(b) an air tight shell that surrounds the inner pre-cut foam, wherein the air tight shell is any type of fabric having an air tight backing material or laminated with an air tight material;

(c) an air valve that adjusts an incline angle of the cantilever seat cushion by deflating or inflating the seat, wherein the incline angle of the cantilever seat cushion is in a range from 10 to 25 degrees, wherein said cantilever seat cushion has six surfaces and has a front side height (F) of 3 to 8 inches, a rear side height (R) of 1 to 4 inches, a depth (D) of 8 to 20 inches and a width size (W) of 10 to 26 inches, wherein the cantilever seat cushion is washable, and wherein the cantilever seat cushion creates four forces that act on a femur in each leg causing a femoral head in each leg to lift up the sitting bones off the seat and push the pelvis and the lumbar against a seat back cushion, said four forces are:

(1) a moment of force caused by weight of hanging legs and feet that acts on the femoral head at a hip joint socket that pushes up the two sitting bones according to formula 1:

$$VTL=2\times VFL\times DkL:DfL,$$

VTL is moment of force acting on the femoral head at the hip joint socket,

VFL is force perpendicular to the femur at the knee joint which is [leg weight]×[Cos Φ], Φ is inclined angle of the cantilever seat, DkL is distance from axis of knee to reference point on the femoral head at the hip joint, and DfL is distance from axis of the femoral head to reference point on the femur, (2) a corresponding force that pushes the femur at the hip joint socket against the seat back cushion according to formula 2:

$$2\times HFL,$$

HFL is corresponding force acting on the femur along incline surface of seat which is [Leg weight]×[Sin Φ], (3) a downward vertical force caused by weight of thighs on an incline surface that acts on a femoral head at a hip socket that pushes up two sitting bones according to formula 3: and $$VTT=2\times VFT\times DrC:DrF,$$

VTT is moment acting on the femoral head at the hip joint socket,

VFT is force perpendicular to the femur which is [thigh weight]×[Cos Φ],

DrC is distance from CHM to reference point on the femur,

CHM is center of hip mass as the mean position of entire hip mass distribution,

Drf is distance from axis of the femoral head to reference point on the femur, (4) a corresponding force to the downward vertical force that pushes the femur at the hip joint against the seat back cushion according to formula 4:

$$VCT=2\times HFT,$$

VCT is corresponding force pushing the femur at hip joint against seat back cushion, HFT is corresponding force acting on the femur along incline surface of seat which is [thigh weight]×[Sin Φ].

15. A method for reducing lower back strain in a human subject, comprising:

placing the cantilever seat cushion according to claim 1 onto a seat, wherein a wide portion F is situated on a forward part of the seat and a narrow portion R is situated on a rear part of the seat, wherein lower back strain in the human subject is reduced when sitting on the cantilever seat cushion.

16. The method according to claim 15, wherein the human subject adjusts the incline angle of the cantilever seat cushion by partially opening and closing the air valve.

* * * * *